United States Patent [19]

Souriau

[11] 3,948,316

[45] Apr. 6, 1976

[54] PROCESS OF AND DEVICE FOR USING THE ENERGY GIVEN OFF BY A HEAT SOURCE

[75] Inventor: Daniel Souriau, Paris, France

[73] Assignee: Gaz de France, Delorme, France

[22] Filed: Feb. 1, 1974

[21] Appl. No.: 438,605

[30] Foreign Application Priority Data

Feb. 6, 1973 France ..... 73.04129

[52] U.S. Cl. ..... 165/105; 176/54; 219/275; 237/67

[51] Int. Cl.[2] ..... F28D 15/00

[58] Field of Search ..... 165/105, 31, 1; 176/54; 122/366; 219/271, 275, 381; 237/67

[56] References Cited

UNITED STATES PATENTS

| | | | |
|---|---|---|---|
| 3,210,005 | 10/1965 | Arnold | 237/67 |
| 3,404,730 | 10/1968 | Kurisu | 165/105 |
| 3,525,670 | 8/1970 | Brown | 165/105 |
| 3,598,177 | 8/1971 | Webster | 165/105 |
| 3,688,083 | 8/1972 | Rice | 219/275 |

*Primary Examiner*—Charles J. Myhre
*Assistant Examiner*—Daniel J. O'Connor
*Attorney, Agent, or Firm*—Kenyon & Kenyon Reilly Carr & Chapin

[57] ABSTRACT

A device for and method of using the heat provided by a heat source and consisting in using as a heat-conveying fluid a substance chemically compatible with porous materials through which the fluid is flowing and which are not substantially wetted by said fluid and subjecting said fluid at the fluid supply to a pressure higher than that of the gas evolved which has passed through a blocking layer included in said porous material and forming a barrier for said fluid in any condition other than the gaseous state.

9 Claims, 7 Drawing Figures

PROCESS OF AND DEVICE FOR USING THE ENERGY GIVEN OFF BY A HEAT SOURCE

The present invention relates to the use of heat given off or yielded by a heat source and its subject matter is essentially a method and a device enabling the use of this heat by resorting to a heat-conveying fluid likely to pass from the liquid state to the gaseous state and vice versa at temperatures about that of the heat source.

The extraction or recovering of heat from a heat source through the medium of a heat-conveying medium capable of absorbing a large amount of heat when passing from the liquid state to the gaseous state and of restoring this amount of heat by condensation has already been used in various methods and devices some of which are well known and currently used. Thus, heat-carrying agents such as boiling water which is effective only at rather low temperatures (i.e., below the critical point temperature $T_c$=374°C) and liquid metals such as sodium or mercury at high temperatures are widely used in various devices using for instance a boiler a condenser and energy-recovering members such as turbines and heat exchangers.

The use of liquid metals, however, as heat-carrying agents in particular raises problems related in particular to metallurgy, corrosion and chemical affinity. Moreover, their high surface tensions may result in a significant delay or time lag in boiling so that the latter occurs for instance at a temperature higher by 200°C than that of the normal liquid-vapour equilibrium point. In such a case vapourization is suddenly initiated at intermittent periods. This phenonmenon difficult to hold under control and resulting in sudden variations in volume and pressure may question the effectiveness and even the service life of the device in which it occurs.

Recently, a new engineering process relating to heat transfer from a heat source has used heat transfer through a heat-carrying or heat-conveying medium in liquid phase travelling through capillarity within a neutral porous support. According to this engineering process the heat-carrying medium is enclosed within a duct lined inside with the neutral porous support; at the spot where the heat-conveying medium is subjected to the action of the heat source it vapourizes thereat and moves to the cold ends of the duct where it gives off its latent heat of vapourization while condensing. It flows back to the heat source in liquid condition by travelling through capillarity within the porous support. This engineering process may make use of liquid metals but on condition that they well wet the porous support with respect to which they have to be neutral and in which they have to circulate through capillarity.

Now heretofore no engineering process has succeeded in putting under control or governing the phenomena relating more particularly to liquid metals which do not wet a quite neutral support for applying them to the use of heat produced from a heat source.

The present invention relates to a device and to a method which enables evaporation without suddenness and in a non-tumultuous way a heat-conveying fluid such in particular as a liquid metal which is not wetting its support and which device and method enable the transfer of large amounts of heat from a heat source to a cold source and this by means of inexpensive and space-saving engineering processes.

A device according to the invention enables the use of the heat supplied by a heat source which gives off heat to a heat-conveying fluid likely to pass from the liquid state to the gaseous state and vice versa at temperatures about that of the heat source is characterized in that it comprises:

at least one first porous material having enough porosity to avoid introducing an excessive head or pressure loss in the flow circuit of said heat-carrying fluid which is flowing through said material;

at least one second porous material supported by said first porous material forming a blocking layer and which has such a porosity that under the operating conditions of the device said heat-conveying fluid can flow through said second porous material only when said fluid is in the gaseous state;

a source for supplying said heat-carrying fluid in liquid state;

a feed of this fluid in liquid state on one side of said blocking layer;

bleeding means for drawing off gaseous fluid, arranged on the other side of said blocking layer;

a header or manifold for said fluid connected to said bleeding means;

and energy-recovering means receiving said fluid from said header or manifold and bringing it back in liquid state to said heat-conveying fluid supply source after having withdrawn or extracted the latent heat of vapourization therefrom.

Excellent results are obtained when the second porous material has fine pores the porosity of which ranges between 8 and 20 percent and the diameter of which is of the order of one micron. As to the first material it may provide either the mechanical support only for the blocking layer with fine pores or provide in addition the medium in which the liquid heat-conveying fluid is fed. In such a case it may consist for instance of nodules which let heat evolve when they are placed in proper physical conditions and/or it may comprise balls made from a very good heat-conducting material such as graphite or a metal so that the layer of said porous material upon being flooded with said liquid heat-conveying fluid forms together with same a good heat-conducting body.

According to the invention a method of utilizing a device for using the heat supplied by a heat source such as described hereinabove is characterized in that it consists in using as a heat-conveying fluid a substance or body which is chemically compatible with said porous materials and which does not substantially wet these materials and subjecting it at said supply of this fluid to a pressure higher than that of the gas formed and which has passed through said blocking layer.

Thus, the heat-carrying fluid which in the liquid state is brought in contact with the blocking layer formed of the material with fine pores may flow through said layer in the gaseous state only. If the fluid in the liquid state is brought in contact with the blocking layer through an aforesaid porous layer having larger or coarser pores, the fluid in the liquid state will remain confined and held therein and will be able to contact the blocking layer consisting of the second material having fine pores. In the first material having larger pores and flooded with the liquid heat-conveying fluid, the latter may be subjected to a pressure higher than that which prevails within the aforesaid bleeding means and thus the liquid fluid may be raised to a temperature higher than that which corresponds to the liquid-vapour equilibrium at the pressure prevailing within said bleeding means. Consequently, a strong evaporation takes place at the surface of the blocking layer which is contacting the liquid heat-carrying fluid thereby enabling said heat-carrying fluid to flow through said blocking layer upon being converted into the gaseous state and to reach therethrough the bleeding means while carrying away or along the latent heat of vapourization of the heat-conveying fluid used. The significant thermal gradient which therefore occurs within the liquid fluid advantageously held within the first porous material having suitable pores enables achievement of a very active heat transfer with transfer rates which are so much the higher as the body consisting of said first porous material flooded with the liquid heat-conveying fluid will have a better heat conductivity.

A device according to the invention is of simple design making use of fabricated elements only porous materials the optimum characterizing features of which are to be defined hereinafter. Moreover it has the advantage of adapting itself to a heat source having a well determined temperature enabling the transfer of heat therefrom with very significant transfer rates while requiring only the selection of the nature of the heat-conveying fluid, of the porous materials used and of the feed and bleed pressures.

It should be pointed out that while the difficulties encountered with liquid metals have been emphasized in the preceding description, this is on account of the fact that the invention enables in particular solving or overcoming these difficulties and that the use of these metals is interesting owing to their high latent heat of vapourization as well as to their wide utilization in corresponding technical fields.

Generally however, the invention is also applicable to heat-carrying agents other than metals provided that they meet the requirements specified hereinabove, namely in particular that they are not or little wetting said second porous material forming the blocking layer. Thus some organic fluids which meet these requirements may be used.

Further objects, characterizing features and advantages of the invention will appear more clearly from the following description made with reference to the accompanying drawings illustrating various non-limiting examplary embodiments and wherein.

Figure 1:
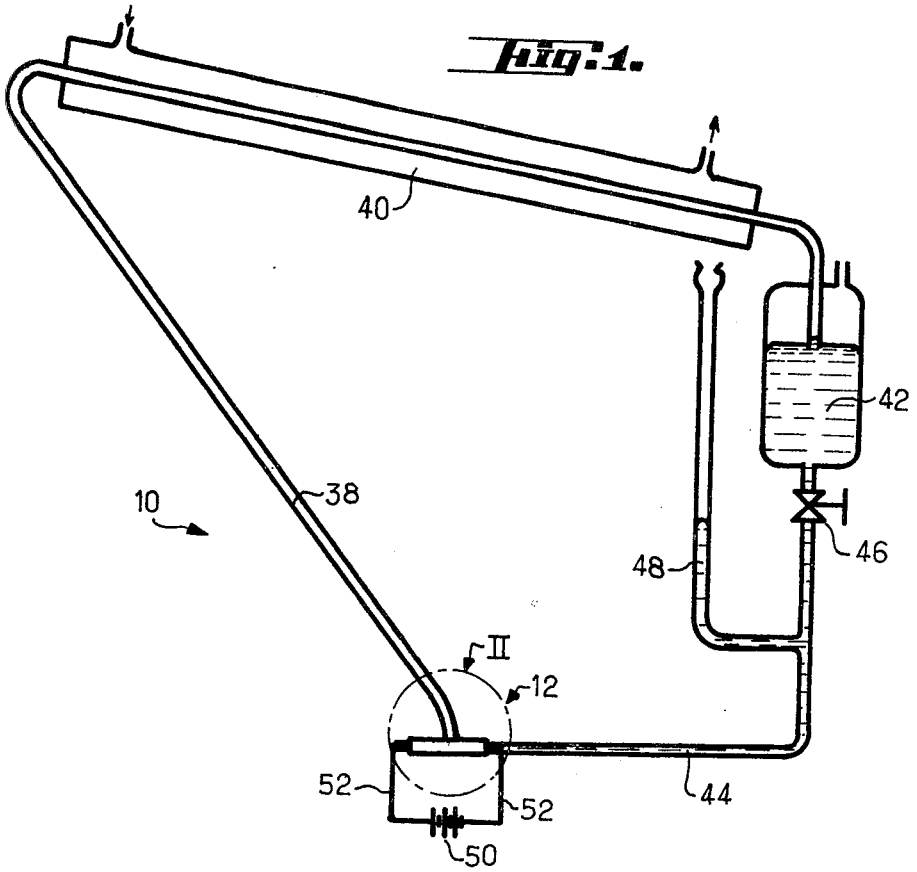
FIG. 1 is a diagrammatic view of the general assembly of a device according to the invention showing its application and enabling to recover the heat provided through Joule effect to a porous structure made from graphite.

The heat originating from a heat source is conveyed within a device according to the invention which has been diagrammatically shown in FIG. 1 by way of examplary embodiment and which has been designed to enable to carry out or run tests and measurements.

Figure 2:
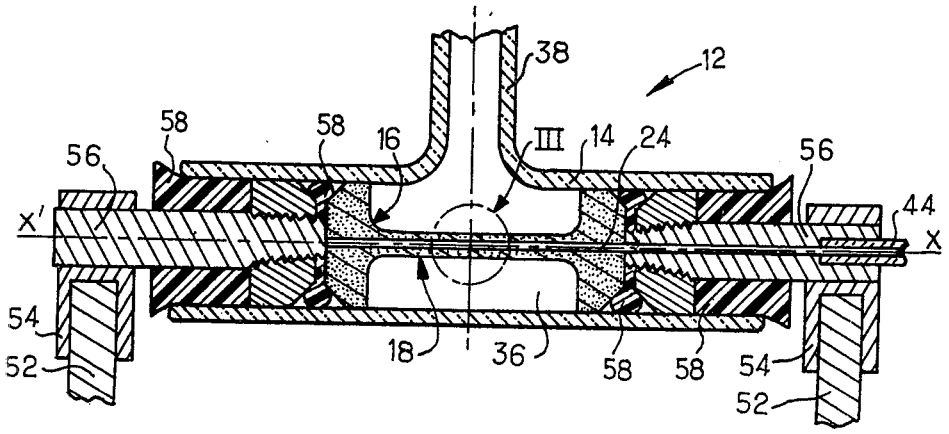
FIG. 2 is an enlarged detailed view of a longitudinal section of the encircled portion II of FIG. 1.

Referring to FIG. 1 the device 10 which is shown therein more especially comprises an assembly 12 the construction of which is illustrated on a larger scale in FIG. 2. In this Figure, the assembly 12 includes a pipe 14 with a fluid-tight wall and a porous structure or porous support 16 arranged within the pipe 14. As shown, the porous support 16 has a cylindrical central portion forming a bar 18 of small cross-sectional area with respect to both ends which are fixedly fitted into the pipe 14. A portion of the bar 18 has been enlarged and depicted in FIG. 3 for better showing the construction thereof.

Figure 3:
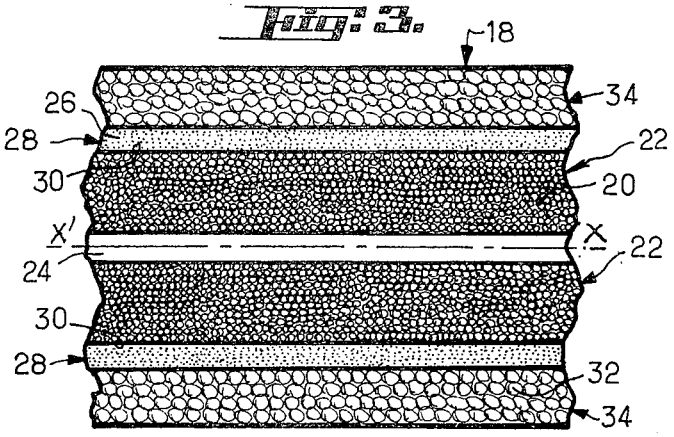
FIG. 3 is an enlarged detailed view of a section of the encircled part III of FIG. 2.

Referring more particularly to FIG. 3, the bar 18 comprises a first material 20 with large or wide pores and provided in the shape of a tube 22 which surrounds a hollow axial portion forming a duct or like passageway 24; in this instance the material 20 is porous graphite the diameters of the pores of which are ranging between from about 2 to 50 microns. A second porous material 26 covers or faces the outer side wall of the tube 22 to provide an annular blocking layer 28; in this instance the material 26 is also porous graphite but the pores of which are smaller than those of the material 20 since their diameters do not exceed 1 micron with a degree of porosity ranging from 8 to 20 percent. The bar 18 further comprises a third porous material 32 having larger or smaller pores with diameters at least equal to those of the second material 26 and the degree of porosity of the material 32 is usually higher than that given with reference to the second material 26. The porous material 32 covers or lines the outer side surface of the blocking layer 28 providing a backing layer 34 made from graphite and serving as a protection or guard cover or like shielding means for the blocking layer 28 while imparting to the bar 18 an adequate mechanical strength within the device.

It appears from FIGS. 1 and 2 that the porous support 16 is arranged within the pipe 14 so that the bar 18 has as a longitudinal axis the centre line X'X of both confronting openings within the pipe 14 and so as to define a chamber 36 with the inner wall of the pipe. The chamber 36 is put in communication with a header 38 which extends as shown in FIG. 1 to the inlet of the bleeding means for drawing off heat and illustrated in FIG. 1 by a condenser 40 which enables extraction of the heat transferred at the porous structure 16 as will appear hereinafter. When issuing from the outlet of condenser 40, the heat-carrying fluid, which has been admitted in the gaseous state into the intake duct 38, has been converted back into the liquid state at the supply source 42 after having given off in the condenser 40 its latent heat of vapourization. The liquid heat-carrying fluid is conveyed through a feed piping 44 to the duct 24 of the porous support 16 shown in FIG. 2. The feed pipe 44 is moreover provided with a valve 46 and with a pressure gauge 48. In this instance the heat-carrying fluid is mercury for reasons to be specified hereinbelow when describing the operation of the device.

According to the working embodiment shown in FIG. 1, an electrical circuit comprising a supply source 50 supplies power between its terminals through the medium of electrical connections 52, 54, 56 to the porous structure made of graphite 16 which forms an electrical resistor. It is seen on the other hand that one of the conducting wires or leads 56 has a conduit extending therethrough and provided an extension of the duct 24 of the porous support 16 to establish communication with the feed pipe 44 for mercury supplied by the source 42 feeding liquid heat-conveying fluid. Moreover, to tightly seal the structure 16 against the open air, both confronting inlets are fitted with sealing members or like packings 58 which are electrical insulators as is the pipe 14.

The device 10 operates as follows. Referring more particularly to FIG. 3, the heat-conveying fluid in the liquid state is fed into the support 16 through the duct 24. The fluid must on the one hand be of a nature chemically compatible with the graphite which is used herein as the material forming the support 16 so that no chemical reaction takes place within this support and on the other hand the fluid should be a substance which does not substantially wet the porous materials 20, 26 and 32 of the support 16 and having a rather high surface tension in the liquid state or liquid-gas interfacial tension, which tension vanishes in the gaseous state according to a known physical law so that this fluid in the liquid state may enter most of the pores of the material 20 forming the tube 22 which is at first contacted by the fluid in the liquid state and in order that the fluid may not flood the pores even the widest ones of the second material 26 with fine pores forming the blocking layer 28. It is in fact only when the heat-carrying fluid is in the gaseous phase that it may enter the pores of the blocking layer 28. It results therefrom that the interface 30 common to the material 20 with wide pores and to the material 26 with fine pores is located at the limit surface up to where the fluid in the liquid state may seep into the bar 18. Among heat-carrying fluids of neutral chemical nature with respect to graphite and which are wetting the latter very little only, in particular mercury and magnesium may be used as liquid metals.

In order that liquid mercury may at least enter the widest pores of the material 20 it should be subjected to a minimum differential pressure between the souruce 42 and the chamber 36. When this pressure is increased the liquid mercury progressively invades substantially all the pores of the porous material 20 with wide pores without however the liquid flow invading the widest pores of the blocking layer 28 having fine pores. The interface in this instance is a surface of discontinuity keeping on one side the liquid under pressure which cannot flow therethrough. Accordingly, within the graphite material 20 with wide pores the liquid-vapour equilibrium temperature $T_1$ is higher than the liquid-vapour equilibrium temperature $T_2$ under the lower pressure prevailing in the chamber 36 and which is substantially identical with that prevailing within the backing layer 34.

Now according to the device previously described, the heat is evolved within the porous support 16 proper through Joule effect. The power dissipated within the support 16 depends upon the value of electrical resistance of the grains of graphite which form the support and upon that of mercury it contains as well as upon the magnitude of the current delivered by the supply source 50.

The liquid mercury being heated up within the tube 22 will tend to assume the liquid-vapour equilibrium temperature $T_1$. However at the limit surface of the liquid which corresponds to the interface 30 an unbalance occurs because of the difference between the equilibrium temperature values $T_1$ and $T_2$. Thus, an evaporation is initiated at the interface 30 which evaporation is made possible by the fact that the gaseous mercury may pass through the blocking layer 28 and all the more through the backing layer 34 to evolve into the chamber 36. This evaporation cools the support 16 in the region of said interface.

A significant thermal gradient thus builds up within the material 20 with wide pores and assist in providing a very active heat transfer and this more especially as the heat-carrying fluid exhibits a high thermal conductivity in the liquid state and a low viscosity in the gaseous condition. Accordingly, liquid magnesium could also have been used for instance instead of mercury, the former exhibiting a thermal conductivity 10 times higher than the latter and a coefficient of viscosity about twice smaller in the gaseous state than that of mercury. In the example chosen which illustrates a device for testing and research, however, the high melting temperature of magnesium would have required the use of materials capable of withstanding same in the appendant portions of the assembly such as the container 42 and the control device 46 as well as of a heat insulating casing likely to impede observation; it is why mercury is preferred in spite of the higher coefficient of viscosity of mercury vapour with respect to magnesium vapour which requires to significantly reduce the thicknesses or the porous materials used in the support 16.

By way of example with the device 10 as shown in FIG. 1 and when the graphite bar 18 in FIG. 2 is given an inner diameter of 1 mm, an outer diameter of 4 mm and a length of 32 mm so as to provide an evaporation surface of 1 $cm^2$, the device 10 readily transfers a heat power of 100W to 300W with a flow rate of 0.275 litres of mercury per hour at the highest power.

The ascertained limitations set upon heat transfer by the device described hereinabove are accounted for as follows. According to the diameter of the pores of the porous material 20 with wide pores, to its degree of porosity, to its thickness and according to the viscosity and pressure of mercury within the materials 20 and 26, a head or pressure loss between the feed line 44 at the support 16 and the chamber 36 results therefrom, this pressure or head loss being of the order of 0.2 bar at most in the aforesaid example. The lowest overpressure to be imparted to the liquid mercury is therefore of 0.2 bar.

Moreover, there is a pressure difference limit value not to be exceeded between that of the duct 24 and that of the chamber 36. It has in fact been shown previously that the extraction of heat in accordance with the invention through the medium of a heat-conveying agent which does not wet the porous materials is based upon the presence of a surface of discontinuity or interface 30. The presence of this surface of discontinuity thus involves that the heat-carrying fluid does not invade the pores even the widest ones of the material with fine pores forming the blocking layer 28. In the exemplary structure referred to hereinabove the layer 28 has no pore with a diameter above 1 micron and the limit value of the pressure difference not to be exceeded is then 10 bar.

Figure 4:
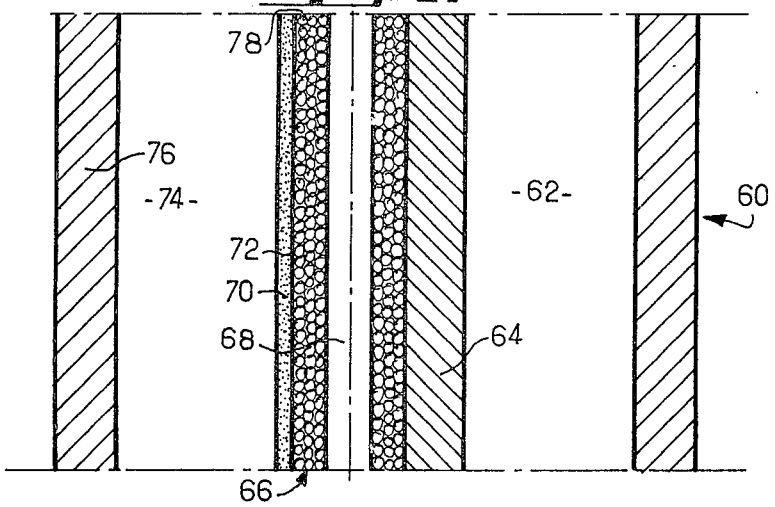
FIG. 4 is a view in axial section of an alternative embodiment of a device according to the invention.

Referring now to FIG. 4 there is shown an embodiment applicable industrially and relating to a device according to the invention, designed to recover the heat of a heat source consisting of a hot fluid such as smoke. According to the embodiment illustrated the device 60 comprises a duct 62 at least one portion 64 of the wall of which consists of a good heat conducting material. This wall 64 contacts a corresponding portion of a layer 66 provided in a good heat-conducting porous material with wide pores such as the material 20 which has previously been taken as an exemplary embodiment for the bar 18 of the device 10. As shown in FIG. 4, through the layer 66 extends at least one duct 68 parallel to the wall 64 of the duct 62. Furthermore the layer 66 made of the material with wide pores is covered or lined by a blocking layer 70 over a surface 72. The blocking layer 70 consists of a material with fine pores of the same kind as the material 26 defined with reference to the description of the device 10. A chamber 74 provides the bleeding or draw off means designed for collecting the heat-carrying fluid in the gaseous state and it is limited by the blocking layer 70 and an outer wall 76.

It should however be pointed out that it is not always necessary to form the ducts inside the layer with wide pores such as the duct 68 inside the layer 66. As a matter of fact according to the more diameter in the layer 66, its degree of porosity, the viscosity of the heat-carrying liquid fluid used, the flow may be effected through infiltration from at least one section 68 of the layer 66. In this instance the length of the layer 66 should of course be taken into account. In the structure which has just been described, it should be noted that it is the layer 66 with wide pores likely to be invaded by the heat-carrying liquid fluid which forms the supporting layer providing a mechanical backing for the thin blocking layer 70.

The operation of the device 60 is similar to that of the assembly 12 shown in FIGS. 1 and 2 and described previously. With reference to FIG. 4, the hot smoke arriving in the duct 62 heats up the wall 64 which transfers the heat of the layer 66 of material with wide pores invaded by the heat-carrying liquid fluid fed through the duct 68. The layer with wide pores 66 invaded by the heat-conveying liquid fluid thus forms a collector for the heat to be transferred. In order to increase the heat conductivity of the body consisting of the layer 66 flooded by the heat-carrying liquid fluid, balls made from a good heat-conducting material such as graphite or a metal (sintered alluminium balls for instance), may be embedded into the layer 66. The heat-conveying liquid fluid raised to a high temperature vapourizes when contacting the blocking layer 70 through which it may not flow in the gaseous state. At the interface 72 separating the blocking layer 70 from the supporting layer 66 a very large heat transfer is thus effected. The heat-conveying fluid in the gaseous state is recovered in the chamber 74 forming a collector; it may then undergo a cycle such as that shown in FIG. 1 so as to give off its latent heat of vapourization within a condensor before being fed again in the liquid state into the duct 68.

Figure 5:
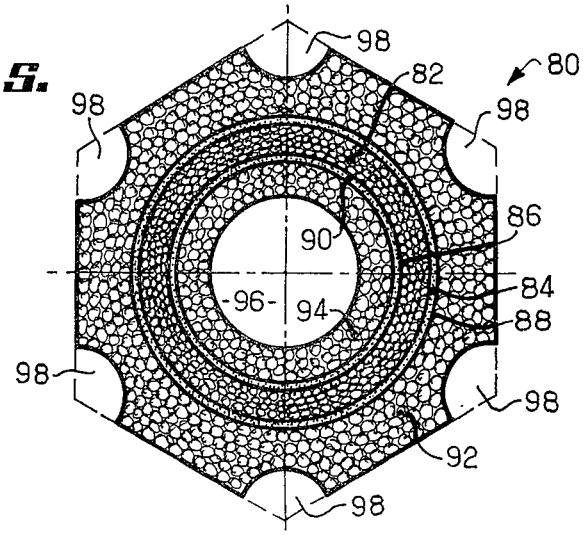
FIG. 5 is a cross-sectional view of a porous structure made in accordance with the invention and showing another alternative embodiment.

FIG. 5 shows an alternative embodiment wherein the heat transfer occurs on both concentric interfaces. In this example the device exhibits a general structure in the shape of a hexagonal bar 80. This bar comprises a tube forming an annular layer 82 consisting of a porous material with wide pores such as for instance graphite similar to the material 20 forming the bar 18 in FIG. 3; the layer 82 may also comprise nodules likely to let heat evolve therefrom. In the tube 82 are provided channels (not shown) for feeding heat-carrying liquid fluid such as magnesium which has to invade same; if the bar is not too long the flow may be effected through simple infiltration from at least one terminal section. The outer and inner side surfaces 84 and 86 of the annular layer 82 are covered or lined with two blocking layers 88 and 90 respectively, consisting of a material with fine pores such as the material 26 forming for instance the blocking layer 28 of the bar 18 depicted in FIG. 3. Moreover both backing layers 92 and 94 are made from a material with wide pores and with a high degree of porosity on the outer side faces of the blocking layers 88 and 90, respectively, so as to strengthen the structure. The backing layer 94 axially comprises a central channel 96 providing bleeding means for drawing off heat-carrying gaseous fluid and the six edges of the hexogonal bar 80 have been cut off to provide outer bleeding means 98 for drawing off the heat-carrying gaseous fluid in association with likewise cut off edges of other adjacent hexogonal bars (not shown) forming a tight filling of bars arranged in honeycomb fashion.

In operation the heat-carrying liquid fluid seeps through the wide pores of the layer 82 and/or the nodules while evolving heat and the heat transfer is effected at both interfaces 88 and 86 when the heat-conveying liquid vapourizes and is converted into the gaseous state after having passed through both blocking layers. A thermal gradient is provided at the interfaces within the heat-carrying liquid fluid and the porous material with wide pores invaded by the same. The heat-carrying gaseous fluid exhibiting a low viscosity easily flows through the blocking layers 88 and 90 to be finally recovered or collected according to the blocking layer through which it has passed within the central or outer bleed channels 96 or 98. The heat is then recovered through condensation of the heat-carrying gaseous fluid which is restored to the liquid stage within the layer 82.

Figure 6:
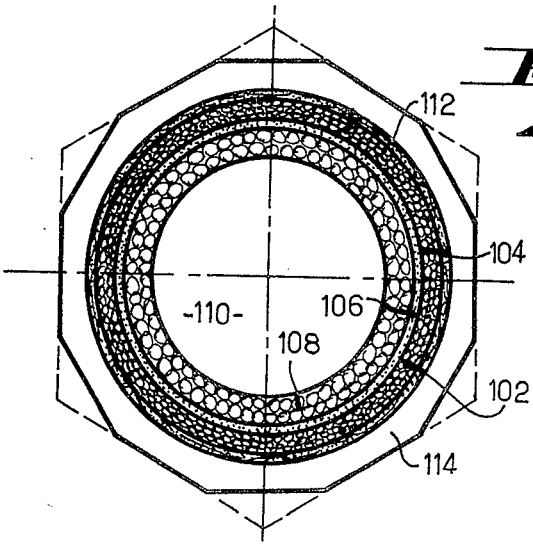
FIG. 6 is a cross-sectional view of further modification.

FIG. 6 shows another alternative embodiment according to the invention. According to this alternative embodiment the structure consists of a bar 100 which comprises a tube forming an annular layer 102 with wide pores made for instance from nodules capable of letting heat evolve and a blocking layer 106 with fine pores deposited on the inner side wall of the annular layer 102 providing an interface 104 between both of them. The blocking layer 106 is also supported inside by a backing layer 108 imparting an adequate mechanical strength to the structure. The backing layer 108 is hollowed out or formed in its centre with a channel 110. Finally about the layer 102 is provided a wall 112 which may consist of carbon covered or lined with an insulating sealing layer or coating 114.

In operation the heat-carrying liquid fluid is fed to the porous layer 102 it invades. Assuming somehow or other that the heat source gives off its heat to this heat-carrying liquid fluid the latter evaporates when contacting the blocking layer 106 through which it passes in the gaseous state to be recovered inside the central bleed channel 110.

Such a device works in a very satisfactory manner. On the other hand it is possible to ventilate the outer surface of the bar 100 with a fluid such as helium for instance thereby facilitating the handling of the bars and enabling to avoid any condensation of heat-conveying fluid at some cool portions of the collectors or headers.

Figure 7:
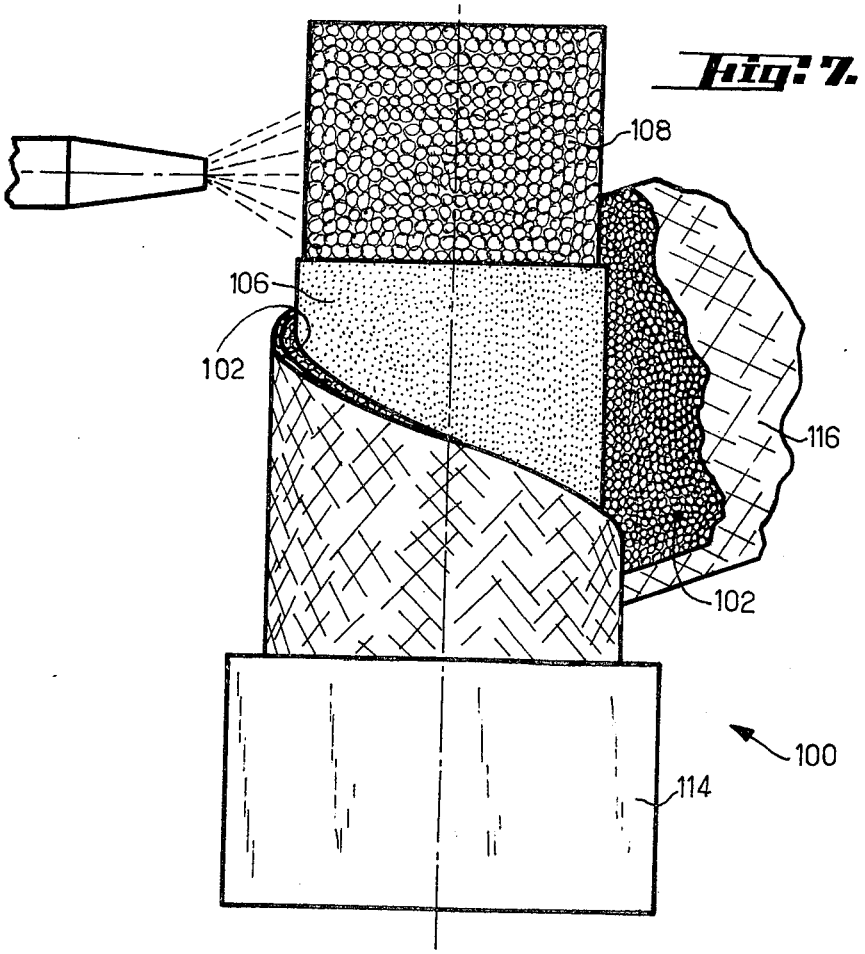
FIG. 7 is a view with parts broken away showing an embodiment of the method of making a porous structure such as illustrated in FIG. 6.

In FIG. 7 there has been illustrated a manufacturing process which may be used to make a bar such as 100 shown in FIG. 6. According to the manufacturing process illustrated one starts initially from a tube forming the inner backing layer 108 made from graphite with wide pores and with very coarse grains, which layer is adapted to serve as a support during the manufacture of the bar and to withstand the effect of inner pressure in operation. Onto the outer surface of the backing layer 108 a thin layer of graphite with fine grains forming the blocking layer 106 is deposited. This deposit may be for instance provided by spraying, coating or even by winding or wrapping a sheet of a porous material having undergone a suitable carbonization treatment about the backing layer 108. Then is provided a regular layer of nodules 102 which may be secured for instance resiliently by means of a strip or tape 116 made from yielding or flexible material which is wrapped or wound about the blocking layer 106 so as to form at the same time the supporting layer 112 shown in FIG. 6; the nodules may possibly be provisionally secured onto the strip or tape 116 by means of a binding or bonding agent which does not leave after heat treatment other traces than those left by a carbon deposit exhibiting pores which do no oppose the flow of heat-carrying liquid metal. Afterwards is deposited the outer layer 114 made from a material yielding after a heat treatment a carbon exhibiting a high mechanical strength and being very little porous which will provide at the same time an outer sealing wall. This deposit may be carried out by extrusion the strip or band 116 temporarily retaining the nodules forming the layer 102 of materials with large pores and moreover preventing the penetration of the paste or like compound into the interstices of the noludes; this deposit may also be carried out through insertion into a tube (not shown) larger by about 15 to 30 percent but which will shrink during the subsequent thermal treatment of the bar thereby ensuring a proper application of the various layers constituting same.

As set forth some resiliency applies the layer 102 to the blocking layer 106. If desired both of these layers may be separated by a small spacing which will of course be invaded by the heat-carrying liquid fluid without changing anything in the operation of the device.

The layer 102 may possibly even be omitted and in such a case the heat-carrying liquid fluid is contained between an outer fluid-tight shell or casing forming the outer wall of the bar and the blocking layer 106 through which it may flow only in the gaseous state.

It should therefore be understood that the invention is not at all limited to the forms of embodiment described and shown herein which have been given by way of examples only the invention including all the means constituting technical equivalents to the means described as well as their combinations if same are carried out according to the gist of the invention and used within the scope of the appended claims.

What is claimed is:

1. In combination with a heat source giving off heat, a heat-carrying fluid likely to be converted from the liquid state to the gaseous state and vice versa at temperatures about that of said heat source, and a flow circuit for said heat carrying fluid to receive heat from said source, the improvement in a device for using said heat comprising:

at least one first porous material means having an adequate porosity to prevent excessive pressure loss from occurring in the flow circuit of said heat-carrying fluid;

at least one second porous material means of lower porosity supported by said first porous material to form a blocking layer with such a porosity that under the operating conditions of said device said heat-carrying fluid may flow through said blocking layer only in the gaseous state;

a supply source means for feeding said heat-carrying fluid in the liquid state;

a feed line means communicating with said supply source for feeding said fluid from said supply source means in the liquid state to one side of said blocking layer;

bleeding means including a chamber for drawing off gaseous fluid arranged on the opposite side of said blocking layer;

a collecting header means for said fluid in the gaseous state connected to said bleeding means;

energy-recovering means connected to said header means for receiving said gaseous fluid from said collecting header and restoring it to the liquid state and means for conducting said heat-carrying fluid in liquid state to said supply source after the extraction of latent heat of evaporization from the gaseous fluid in said energy recovering means.

2. A device according to claim 1, including, on that side of said blocking layer which communicates with said feed line means from said supply source means for said heat-carrying fluid in the liquid state, a layer in contact with said blocking layer of a porous material which exhibits an adequate porosity for avoiding the occurrence of an excessive pressure loss within the flow circuit of the heat-carrying liquid fluid flowing therethrough said layer being formed so that when it is invaded by said heat-carrying liquid fluid it constitutes together with the latter a good heat-conducting body.

3. A device according to claim 1, including, on that side of said blocking layer which communicates with said bleeding means for said heat-carrying fluid in the gaseous state, a supporting layer made from a porous material arranged in contact with said blocking layer means and which said supporting layer has a porosity which is adequate to avoid the occurrence of an excessive pressure loss in the flow circuit of said heat-carrying gaseous fluid flowing therethrough.

4. A device according to claim 1, wherein said second porous material means has fine pores exhibiting a porosity ranging between from 8 to 20 percent and has pores with an average diameter of the order of 1 micron.

5. A device according to claim 1, wherein the chamber of said bleeding means for drawing off said gaseous fluid evolving from said other side of said blocking layer is provided in a backing layer of said first porous material from surfaces cut out in this material.

6. A device according to claim 1, wherein said first porous material means is in the shape of a prismatic annular tube and said second porous material is in contact with at least one of the side surfaces of said tube to form at least one interface wherein a change in porosity takes place.

7. A device according to claim 1, wherein said first material means comprises nodules capable of letting heat evolve.

8. A device according to claim 1, wherein said first material means comprises bolts made from a very good heat-conducting material.

9. A device according to claim 1, wherein said feed line means for said heat-carrying liquid fluid includes within said first porous material means at least one duct formed in said first material.

* * * * *